US009440110B2

(12) United States Patent
Izzo et al.

(10) Patent No.: US 9,440,110 B2
(45) Date of Patent: Sep. 13, 2016

(54) PUSH-UP EXERCISE DEVICE

(71) Applicants: Anthony James Izzo, Davie, FL (US); Nicole Lynne Ciasca, Fort Lauderdale, FL (US)

(72) Inventors: Anthony James Izzo, Davie, FL (US); Nicole Lynne Ciasca, Fort Lauderdale, FL (US)

( * ) Notice: Subject to any disclaimer, the term of this patent is extended or adjusted under 35 U.S.C. 154(b) by 364 days.

(21) Appl. No.: 13/905,206

(22) Filed: May 30, 2013

(65) Prior Publication Data

US 2014/0357459 A1 Dec. 4, 2014

(51) Int. Cl.

| | |
|---|---|
| ***A63B 21/00*** | (2006.01) |
| ***A63B 23/12*** | (2006.01) |
| *A63B 21/002* | (2006.01) |
| *A63B 21/02* | (2006.01) |
| *A63B 22/14* | (2006.01) |
| *A63B 21/04* | (2006.01) |
| *A63B 22/18* | (2006.01) |

(52) U.S. Cl.

CPC ..... *A63B 23/1236* (2013.01); *A63B 21/4035* (2015.10); *A63B 21/0023* (2013.01); *A63B 21/025* (2013.01); *A63B 21/0428* (2013.01); *A63B 22/14* (2013.01); *A63B 2022/185* (2013.01)

(58) Field of Classification Search

CPC ..... A63B 21/00

USPC ..... 482/141, 142, 907, 121

See application file for complete search history.

(56) References Cited

U.S. PATENT DOCUMENTS

| | | | | |
|---|---|---|---|---|
| 3,761,083 | A | 9/1973 | Buchner | |
| 4,623,146 | A | 11/1986 | Jackson | |
| 4,978,122 | A | 12/1990 | Dibowski | |
| 5,626,544 | A * | 5/1997 | Foresto | 482/124 |
| 6,230,339 | B1 * | 5/2001 | McCrink | 4/576.1 |
| 6,716,145 | B1 | 4/2004 | Manailovich | |
| 7,086,999 | B2 | 8/2006 | Jeneve et al. | |
| 7,175,575 | B1 | 2/2007 | Dantolen | |
| 7,442,151 | B1 * | 10/2008 | Berdegue | 482/55 |
| 7,465,259 | B2 | 12/2008 | Mok | |
| 7,713,179 | B2 | 5/2010 | Webber | |
| 7,896,789 | B2 | 3/2011 | Hinton et al. | |
| 8,317,667 | B1 * | 11/2012 | Thomas | 482/121 |
| 2004/0266593 | A1 | 12/2004 | Schwendeman | |
| 2005/0215401 | A1 | 9/2005 | Wilson et al. | |
| 2012/0040811 | A1 | 2/2012 | DeTore | |
| 2012/0258847 | A1 | 10/2012 | Lafferty | |
| 2012/0322630 | A1 | 12/2012 | Hood | |

* cited by examiner

*Primary Examiner* — Jerome W Donnelly

(74) *Attorney, Agent, or Firm* — The Concept Law Group, P.A.; Scott D. Smiley; Mark C. Johnson

(57) ABSTRACT

A pair of identical exercise devices that provides for a pair of hand grips that slide reciprocally in independent axial alignment about their individual devices configured to provide a user with muscular exercise when the user applies force to the hand grips. Each individual exercise device includes a resistance member configured to be engaged by the hand grips for providing the user with resistive exercise.

20 Claims, 5 Drawing Sheets

PUSH-UP EXERCISE DEVICE

FIELD OF THE INVENTION

The present invention relates generally to a push-up exercise device, and, more particularly, relates to a spring-loaded push-up exercise device that provides a combination of isometric and isotonic muscle exercises.

BACKGROUND OF THE INVENTION

This invention relates generally to improvements in strength training exercise devices having resistive slidable handles. In perhaps the most common configuration for strength training exercise devices having resistive slidable handles, the resistive slidable handles are configured in series along a single linear path. In particular, one configuration currently known provides handles that slide laterally towards or away from an equidistant center portion located on a base member. In another configuration currently known, resistance is provided in rotation about an axis. For example, known prior art includes U.S. Patent and Publication Nos. 3,751,083; 4,623,146; 4,978,122; 6,716,145; 7,086,999; 7,175,575; 7,465,259; 7,713,179; 7,896,789; 2004/0266393; 2005/0215401; 2012/0040811; 2012/0322630.

While these devices fulfill their respective objectives and requirements, because the prior art is limited to pushup device that each have a single base with both hand grips placed thereon, the aforementioned prior art does not allow a user to freely position the grip members. Furthermore, the prior art does not even provide for a second push-up device to be used in conjunction with the first push-up device. Nor would it be possible for a person to use two of any of the prior art side by side to accomplish freely positioning the hand grips.

Further incumbent with some of the prior art listed is a fixed relationship between the two pushup handles in relation to a central point. Because the handles all slide laterally between a fixed center portion, the device restricts the muscles that the user can target. The instant invention addresses these and other shortcomings by providing two individual push-up bars each having a grip portion that resistively slides along its own individual line and/or axis and further each individual push-up bar configured to provide a user with simultaneous isometric and isotonic exercise. The push-up bars are further utilized in accordance with the instant invention to overcome the problems with the prior art as discussed above.

SUMMARY OF THE INVENTION

The invention provides a push-up exercise device that overcomes the hereinafore-mentioned disadvantages of the heretofore-known devices and methods of this general type that provides a new push-up/plank exercise device uniquely configured to target chest, back, and abdominal muscles.

With the foregoing and other objects in view, there is provided, in accordance with the invention, a push-up apparatus comprises a first push-up device. The first push-up device has a first base member that is adapted to rest on a supporting floor surface. A first grip member secured to the first base member that is adapted to be gripped by a first hand of a user and further adapted to slidingly axially engage a first resistance member when a force applied to the grip member by the user. A second push-up device has a second base member that is adapted to rest on the supporting floor surface. A second grip member is secured to the second base member that is adapted to be gripped by a second hand of the user and is further adapted to slidingly axially engage with a second resistance member when a force is applied to the grip member by the user.

In accordance with a further feature of the present invention, each of the first and second grip members are adapted to slidingly compress in relation to at least one axis. In one embodiment, the first grip member is adapted to slidingly engage the first resistance member when moving along a first axis and the second grip member is adapted to slidingly engage the second resistance member in relation to an adjustable second axis. The adjustable first axis and the second axis are non-collinear.

In accordance with yet another feature of the present invention, the first push-up device is freely positioned in relation to the second push-up device and in relation to the user. This allows the user to freely choose the direction for which the user will slide the grip members to incorporate exercise of different muscles, as well as the distance between each of the push-up devices and/or the user's body. Yet further, each of the first push-up device and the second push-up device of the instant invention may be individually orientated with respect the user's body, without relation to the other push-up device.

In accordance with yet another feature of the present invention, the first grip member is axially aligned with the first resistance member. The second grip member is axially aligned with the second resistance member.

In accordance with a further feature of the present invention, the first grip member is positioned perpendicular to the first resistance member. The second grip member is positioned perpendicular to the second resistance member.

In accordance with a further feature of the present invention, the first base member and the second base member may each include an unstable lower surface adapted to provide user instability under load. Yet further, the unstable lower surface may define a bowed supporting surface to permit the user to roll the push-up device for additional exercise benefits.

In accordance with yet a further feature of the present invention, the unstable lower surface includes non-slip properties.

In accordance with another feature of the present invention, the unstable lower surface may define a flexible bladder at least partially filled with air.

In accordance with another feature of the present invention, the first base member may be adapted to removably couple to the second base member to form a single push-up device.

In accordance with yet another feature of the present invention, at least one of the first resistance member and the second resistance member is selectively replaceable.

In accordance with a feature of the present invention, an adjuster disposed, as commonly understood in the art, on the push-up apparatus that may be operable to enable the user to selectively adjust the resistance on at least one of the first grip member and second grip member.

In accordance with a feature of the present invention, each of the first and second grip members has cushioned outer surfaces. The first base member sandwiches a first support bar, the first support bar supporting the first grip member.

In accordance with a feature of the present invention, a push-up exercise device is taught that comprises a handle affixed to a handle base; a resistance member selectively coupled to the push-up exercise device adapted for providing linear resistance in a direction as positioned by the user.

In accordance with an embodiment of the present invention, a push-up apparatus has a first push-up device. The first push-up device comprises a first base member adapted to rest on a supporting floor surface; a first sole grip member secured to the first base member adapted to be gripped by a first hand of a user and further adapted to slidingly axially engage a first resistance member from a force provided by the user. A second push-up device that has a second base member adapted to rest on a supporting floor surface; a second sole grip member secured to the second base member adapted to be gripped by a second hand of the user and further adapted to slidingly axially engage a second resistance member from a force provided by the user.

A method for muscular exercise comprises providing a first push-up device. The first push-up device comprises a first base member adapted to rest on a supporting floor surface; a first grip member secured to the first base member adapted to be gripped by a first hand of a user and further adapted to slidingly axially engage a first resistance member from a force provided by the user. The method further comprises providing a second push-up device. The second push-up device comprises a second base member adapted to rest on a supporting floor surface; a second grip member secured to the second base member adapted to be gripped by a second hand of the user and further adapted to slidingly compress a second resistance member when a force is applied to the grip by the user; wherein the first push-up device may be operated in disconnected relation to the second push-up device. The method further includes simultaneously placing a downward force and opposing lateral forces with respect to the floor surface on the first grip member and the second grip member and moving the first grip member closer to the second grip member.

In accordance with an embodiment of the present invention, the method includes compressing axially the first and second resistance members during muscular exercise.

In accordance with yet another embodiment of the present invention, the method includes disengaging a removable portion of at least one of the first and second base members from at least one of the first and second grip members.

In accordance with still yet another embodiment of the present invention, the method includes replacing the first and second resistance members, each having a first resistance level, with at least one new resistance member having a second resistance level different than the first resistance level.

In accordance with still yet another embodiment of the present invention, the method includes rolling at least one of the first and second push-up device along a perimeter edge of at least one of the first and second base member.

Although the invention is illustrated and described herein as embodied in a dual push-up exercise apparatus, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting, but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
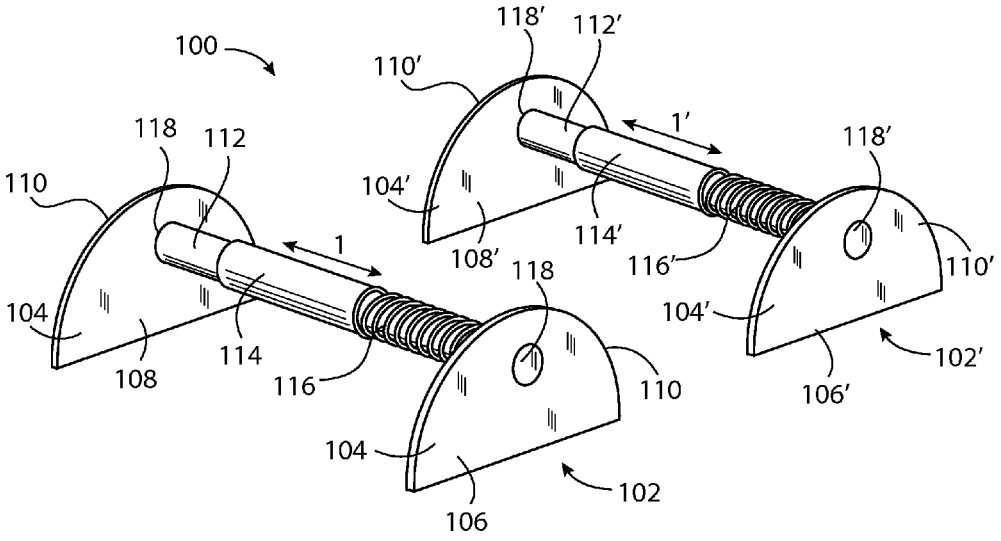
FIG. 1 is a perspective view of two push-up exercise devices in accordance with the features of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The instant invention operates to provide a user with variation to the standard push-up through a highly effective entire upper body workout for people at all fitness levels. The instant invention has resistance members, such as springs or resistant bands, that are useful for specific muscle activation/isolation. By adding springs, or other resistant members, to a standard push-up stand, the instant invention provides for an additional plane of resistance. This is significant because users can engage the device while performing upper-body exercises such as push-ups and planks to combine isometric and isotonic exercise. Additionally, the instant invention provides for two individual hand grip apparatus that establish a greater range of motion and muscle activation than the prior art because each individual hand grip apparatus may be selectively positioned relative to both the other hand grip and the user.

By rotating each individual hand grip 360 degrees about the plane defined by a floor for which the hand grip rests, the user can adjust the direction from which the axial sliding resistance is provided. For example, the user, in a push-up position having his or her hands on each of the individual handgrips, can position the hand grip such that the user must push the hand grips outward to the sides against the resistant spring. When the handgrips have been placed so that the handgrips must be pushed outwards, performing an outward compression engages back muscles unreachable during traditional push-ups, such as rhomboids, trapezius muscles, and posterior deltoids. Alternatively, the user can position the handgrips such that the user, in a push-up position having each hand on one of the two individual hand grips, must push the hand grips downward towards the user's feet and knees, which activates the abdominal muscles of the user.

In addition, the distance between each individual handgrip can be adjusted by the user to target different muscles and perform push-ups, planks, mountain climbers, all of which are commonly understood exercises, with the grips selectively positioned in: (1) wide grip; (2) a normal grip; (3) a narrow grip; or (4) a staggered grip, which are commonly understood hand positions. In combination with these selective positions of the handgrips, the user's body can be neutral; the user's upper body can be elevated to stimulate lower chest muscle activation; or the user's feet can be elevated to stimulate upper chest muscle activation.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of a set of push-up bars 100, as shown in FIG. 1, includes two individual and independent push-up bars 102, 102'. Each of the push-up bars 102, 102' includes a base 104, 104'.

The push-up bars 102, 102' each are formed having opposing support members 106, 108, 106', 108'. Each of the bases 104, 104' is formed having a distal perimeter edge 110, 110' adapted to contact a surface, such as a floor. The push-up bars 102, 102' each have a center shaft 112, 112'. The center shaft for each of the push-up bars 102, 102' is sandwiched by opposing support members 106, 108, 106', 108', respectively. Grip members 114, 114' slide in a reciprocating fashion about the center shaft 112, 112' in axial alignment according to arrows 1, 1'. The grip members 114, 114' engage a resistance member from a force provided by a user. In operation, the user may either push against and/or pull against the resistance members 116, 116', either individually or in combination, via the grip members 114, 114'. In one embodiment, the resistance members 116, 116' are springs that are compressed or stretched to provide a user with resistance-based exercise.

In the configuration shown in FIG. 1, each of the resistance members 116, 116' are sandwiched between one of the grip members 114, 114' and one of the opposing support members 106, 106'. The grip member 114 is adapted to receive force from one of the user's hands and the other grip member 114' is adapted to receive force from the other user's hand. When user force is placed on the grip members 114, 114', either individually or in combination, at least one of the resistance members 116, 116' is compressed, thereby providing exercise resistance to the user.

In a particular embodiment, the push-up bars 102, 102' may each include handgrips placed about the push-up bars 102, 102' that are in addition to grip members 114, 114'.

In a particular embodiment, grip members 114, 114' are the sole handgrips such that no additional handgrips are to be placed about each of the push-up bars 102, 102' providing a simplified and cost effective solution. In addition, by providing two exercise devices 102, 102' the manufacturer may reduce the size of the base for which the grip members are coupled, thereby reducing the overall cost of manufacturing.

In a particular embodiment, grip members 114, 114' are the sole sliding hand grip members capable of sliding such that no additional handgrips slide in axial alignment to grip members 114, 114' that are placed about each of the push-up bars 102, 102'.

Figure 9:
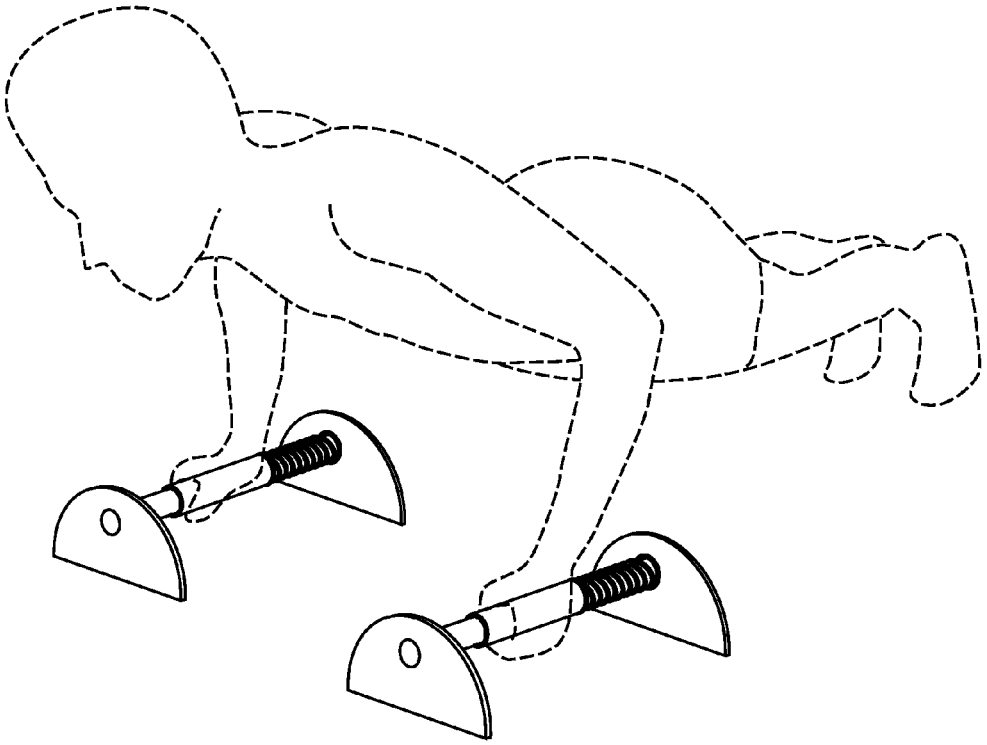
FIG. 9 is a perspective view of two push-up exercise device being individually orientated with the shaft in parallel alignment in accordance with the features of the present invention.

As depicted in the combination of FIGS. 1 and 9, the user may position the push-up device to allow the user's chest to move downward and touch the floor surface that is supporting opposing support members 106, 108, 106', 108'.

As depicted in FIG. 1, the opposing support members 106, 108 and 106', 108' for each of the push-up bars 102, 102' each centrally support the center shaft 112, 112', respectively. In one embodiment, at least a portion of each of the distal perimeter edges 110, 110' includes a bowed, or otherwise curved, surface. While the user grips the grip members 114, 114', the curved surface permits the user to roll, push, and/or pull, each of the push-up bars 102, 102' individually, or in unison, along the bowed portion of the perimeter edges 110, 110' providing for increased muscular exercise. The distal perimeter edges may be rubberized to promote a solid connection between the push-up bars 102, 102' and the floor, particularly as the user rolls, pushes, and/or pulls the push-up bars 102, 102' onto the curved surface. The grip members 114, 114' may be positioned specifically for rolling the push-up bars to provide an instability factor and different hand positioning, which are both key factors of muscle confusion, which is very important for muscle development.

Figure 2:
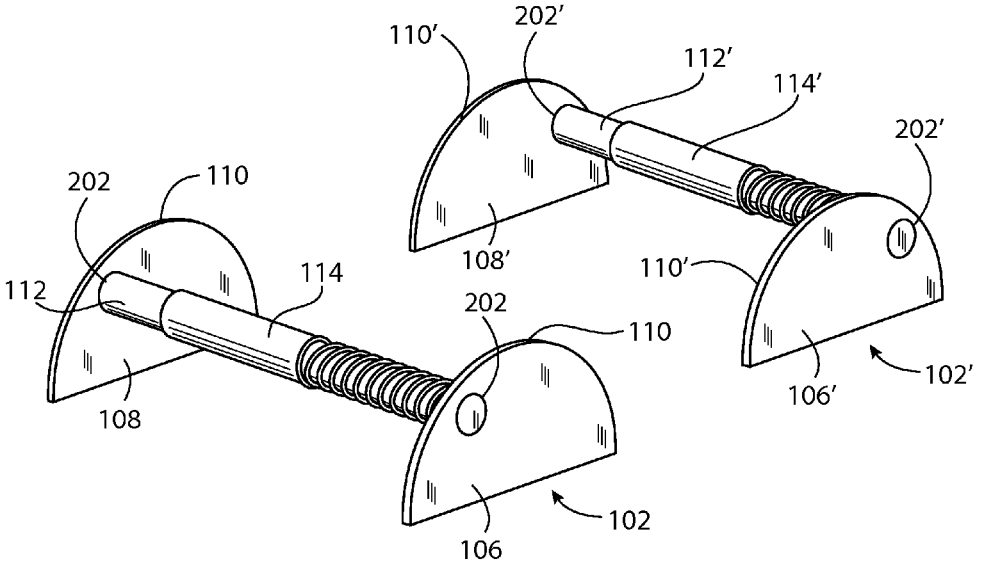
FIG. 2 is a perspective view of two push-up exercise devices having offset handles in accordance with the features of the present invention.

FIG. 2 depicts one alternative embodiment wherein the opposing support members 106, 108 and 106', 108' for each of the push-up bars 102, 102', respectively, each support the center shaft 112, 112', at a position 202, 202' offset from center. This configuration requires the user to exhibit a significant amount of muscle strength in order to roll the device along the curved portion of the perimeter edge 110. Further, the user, in a push-up or plank position, can hold the device on its perimeter edge in an isometric hold to strengthen the user's stabilizing muscles. In an embodiment of the present invention, the connection between the center shaft 112, 112' and the opposing support members 106, 108, 106', 108' is configured to provide sufficient space between the grip 114, 114' and the curved portion of the perimeter edge 110, 110' to allow the user to grip member 114, 114' without the user's hands contacting the ground while the user rolls the push-up bars 102, 102' along the curved portion of the perimeter edge 110, 100'.

Figure 3A:
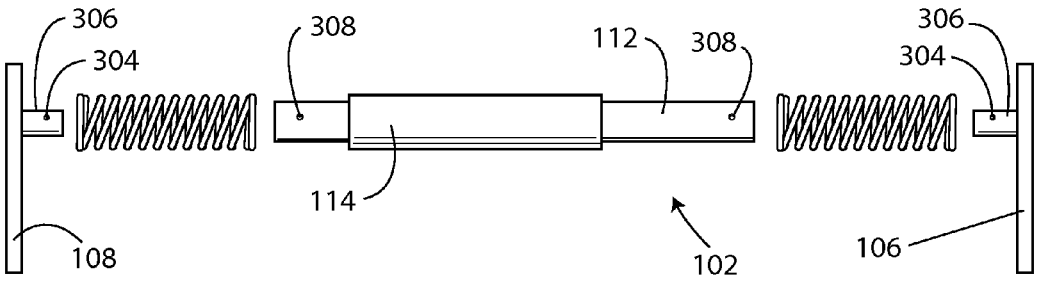
FIG. 3*a* is an elevational exploded view of a pushup-exercise device in accordance with the features of the present invention.
Figure 3B:
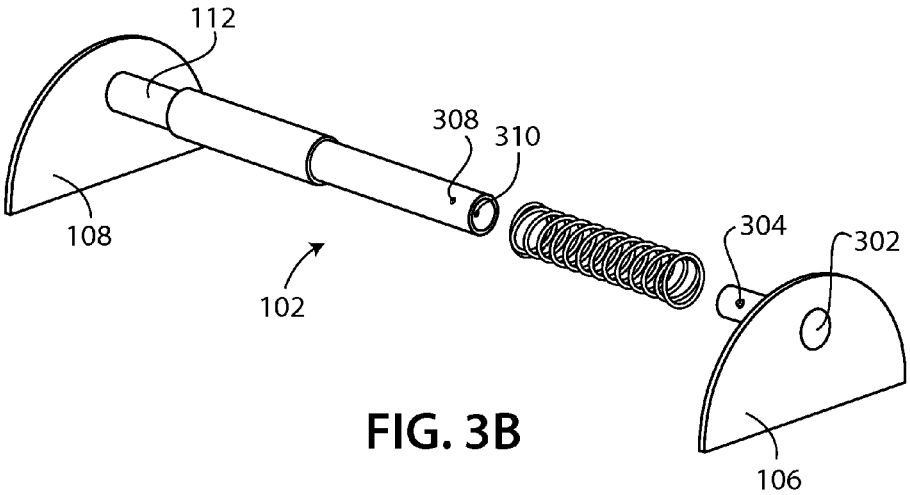
FIG. 3*b* is a perspective exploded view of a push-up exercise device in accordance with the features of the present invention.

FIGS. 3A and 3B each depict an embodiment wherein for each of the push-up bars 102 at least one of the opposing support members 106, 108 shall releasably secure, either directly or indirectly, to the center shaft 112. The grip member 114 may be removed from the center shaft 112 to add or remove one or more springs. Referring now to FIG. 3B, at least one of the opposing side members 106, 108 includes a depressible button 302 configured to be depressed by a user. Depressing the button 302 causes the ball bearing frictional locking mechanism 304 mounted on male mating member 306 to releasably attach and detach at least one of the opposing side members 106, 108 to the shaft 112. The male mating member 306 is configured to be inserted into shaft 112. The ball bearing frictional locking mechanism will engage at least one aperture 308, 310 within the shaft 112.

Once at least one of the opposing support members 106, 108 have been detached from the shaft 112, the resistance member 116, such as a spring, may be removed from the shaft 112 wherein the user may optionally replace the resistance member 116 with resistance members of various resistance. The user may optionally place one or more springs on the shaft 112. In this manner, the user can switch the resistance members for a resistance necessary for the particular user, thus allowing for the selective coupling (of the replacement) of a resistance member. For example, the resistance for one user may be too much resistance based on their muscle composition and level of fitness; thus, the instant system allows the user to switch the resistance on the push-up bar 102.

Figure 4:
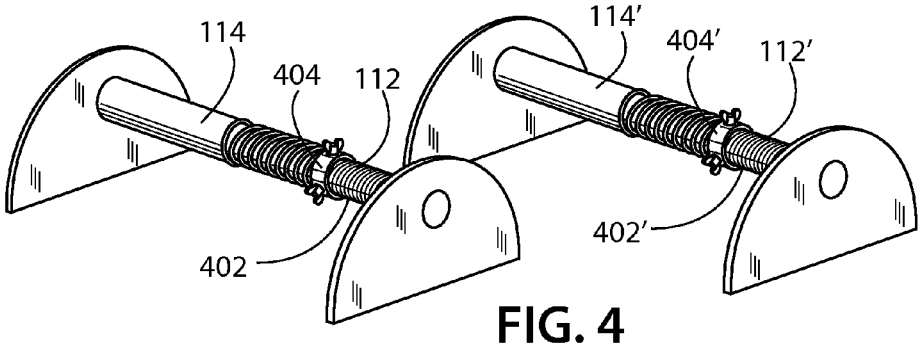
FIG. 4 is a perspective view of a push-up exercise device having a threaded center support in accordance with the features of the present invention.

As depicted in FIG. 4, the center shaft 112 includes outward facing male threading 402 that mates with a member 404, such as a wing nut, having inward facing female threading (not pictured) that may be rotatably or otherwise secured along the body of the center shaft 112 for causing compression of the resistance member 116, and thereby increasing the force required by the user to begin to move the grip member 114.

In one embodiment shown in FIG. 4, the grip member 114 and the resistance member 116 may extend across substantially the entire length of the shaft 112. It is not necessary to use member 404 and the user may optionally remove member 404 in accordance with the embodiments shown in FIGS. 3A and 3B. In this manner, the grip member 114 and the resistance member 116 together extend substantially across the entire center shaft 112 between the opposing support members 106, 108. It is particularly pointed out that in this paragraph, no additional members for gripping are in axial sliding relation about the center shaft 112 and/or positioned between opposing support members 106, 108.

As depicted in FIGS. 1-4, the grip member 114 is formed for grasping with a hand. The grip member 114 may be formed with padding formed from common materials such as rubber, foam, plastic, and other compositions commonly used as grip members for exercise equipment. The padding may include ridges for influencing finger placement about the grip member 114. The padding helps to prevent the user from losing hold of the grip member 114, particularly during workouts when the user's hands begin to sweat.

Figure 5:
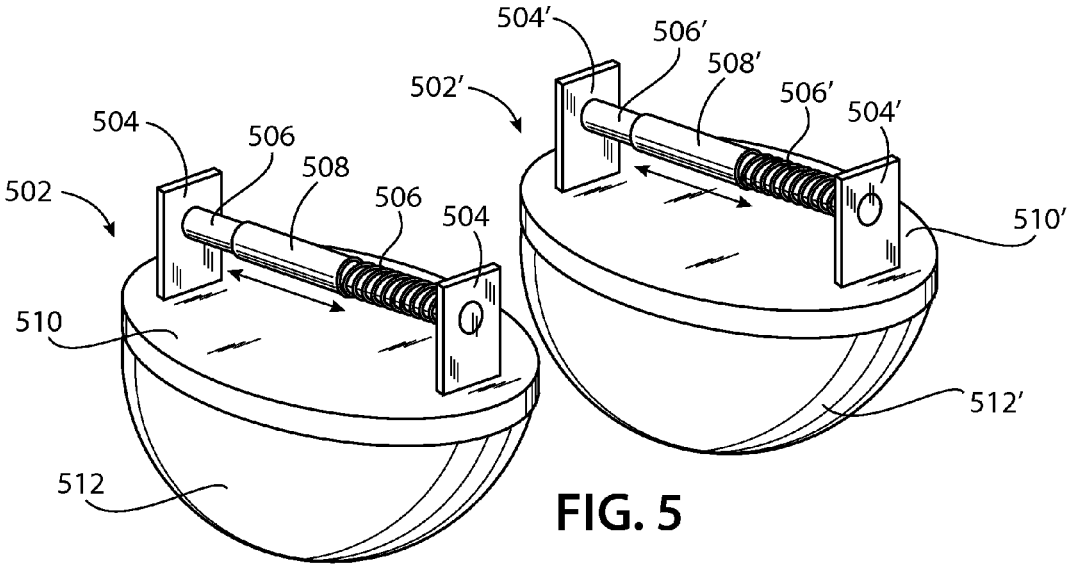
FIG. 5 is a perspective view of two push-up exercise devices having an unstable base and bladder in accordance with the features of the present invention.

FIG. 5 shows an illustration of two push-up bars 502, 502' according to a particular embodiment of the present invention. Any of the features shown in FIGS. 1-3B may be incorporated into the embodiment of FIG. 5 without departing from the spirit and scope of the instant invention. The push-up bars 502, 502' include grip members 508, 508' that are secured to the side support members 504, 504' via the central shaft 506, 506'. The shafts 506, 506' each secure to a side support member 504, 504' for supporting a user exercising on the push-up bars 502, 502'. The grip members are configured to slide axially in accordance with the spirit of the present invention. Each of the side members 504, 504' are secured on their ends to the top of an instability base 510, 510'. The instability base 510, 510' can be formed with an inflatable bladder 512, 512' secured at its bottom of the instability base. In operation, the user gripping the grip members 508, 508' is provided with an unstable push-up exercise, which combines instability that results from, for example, an inflatable bladder 512, 512' with slidingly axially aligned resistance push-up exercise.

Figure 6:
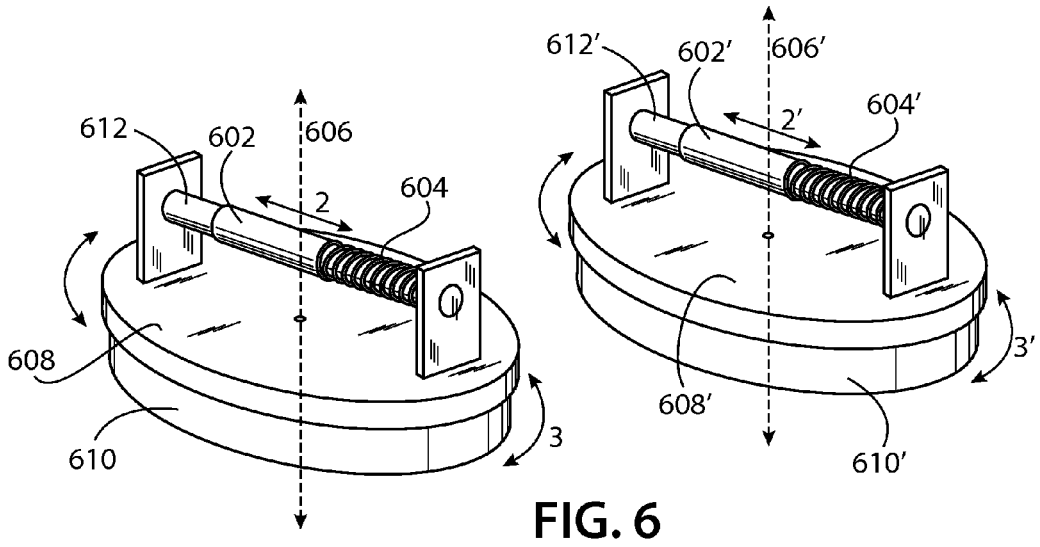
FIG. 6 is a perspective view of two push-up exercise devices having grip members that both rotate and slide axially along the length of the handles in accordance with the features of the present invention.

FIG. 6 relates to an improvement on U.S. Pat. No. 2,896,789 and U.S. Patent Publication No. 2004/0266593. The combination of those inventions relate to a push-up device having a rotatable resistive body. The improvements of the present invention add the additional feature of providing a grip member 602, 602' that slides in a reciprocating fashion about the center shaft 612, 612' in axial alignment. The grip members 602, 602' engage resistance members 604, 604' from a force provided by a user. In operation, the user may either push against and/or pull against the resistance members 604, 604', either individually or in combination, via the grip members 602, 602'. In one embodiment, the resistance members 604, 604' are springs that are compressed or stretched to provide a user with resistance based exercise. In addition, the user is able to rotate the handles about a central axis 606, 606' caused by the grip member base 608, 608', being coupled with the grip members 602, 602', rotates about floor base surface 610. The floor base surface 610 is configured to securely rest against the floor to permit the user to exercise according to the instant invention. In particular, the combination of the axially aligned sliding grip members 602, 602' sliding along arrow 2 coupled with the axially aligned rotation of the grip members 602, 602' rotating about arrow 3 provides for increased muscle activation.

FIGS. 5 and 6 may be combined in an embodiment to provide an unstable base 510 that secures on its top to the bottom of the floor surface base 610 allowing the user to experience instability, in addition to both sliding resistance and rotational resistance.

Figure 7:
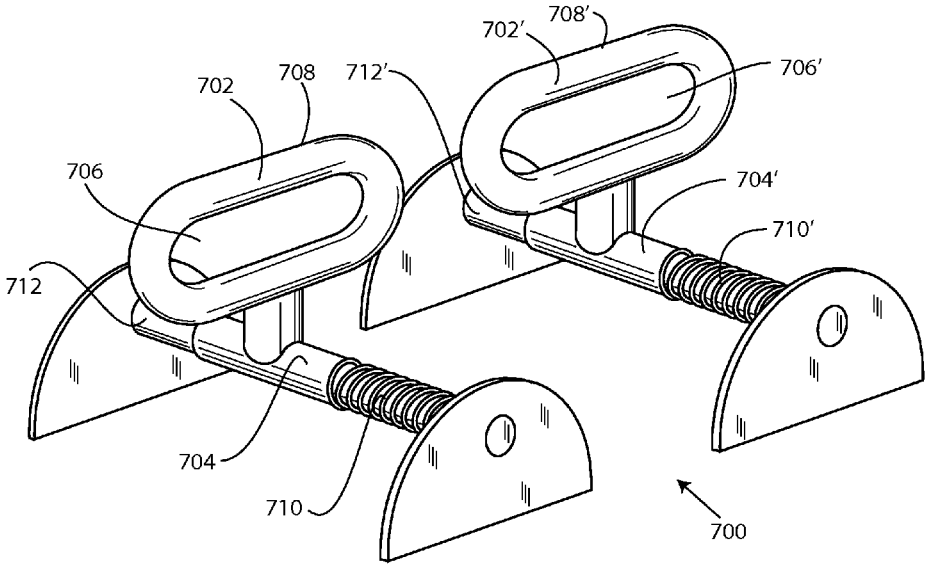
FIG. 7 is a perspective view of two push-up exercise devices having a grip set perpendicular to the resistance member in accordance with the features of the present invention.

FIG. 7 shows a substantially similar variation to the embodiment depicted in FIG. 1, wherein each of the grip members 702, 702' include an elongated portion 704, 704' that axially slides on the central shaft 712. Each of the grip members 702, 702', have an aperture 706, 706' spaced to allow the user's fingers to pass through while gripping the upper surface 708, 708' of the grip members 702, 702'. Each of the upper surfaces 708, 708' extend perpendicular to the resistance members 710, 710'. The orientation of the upper surfaces 708, 708' of the grip members 702 provide an unique hand orientation compared to other known art, such that the user's hands is orientated perpendicular to the resistance member 710.

Figure 8:
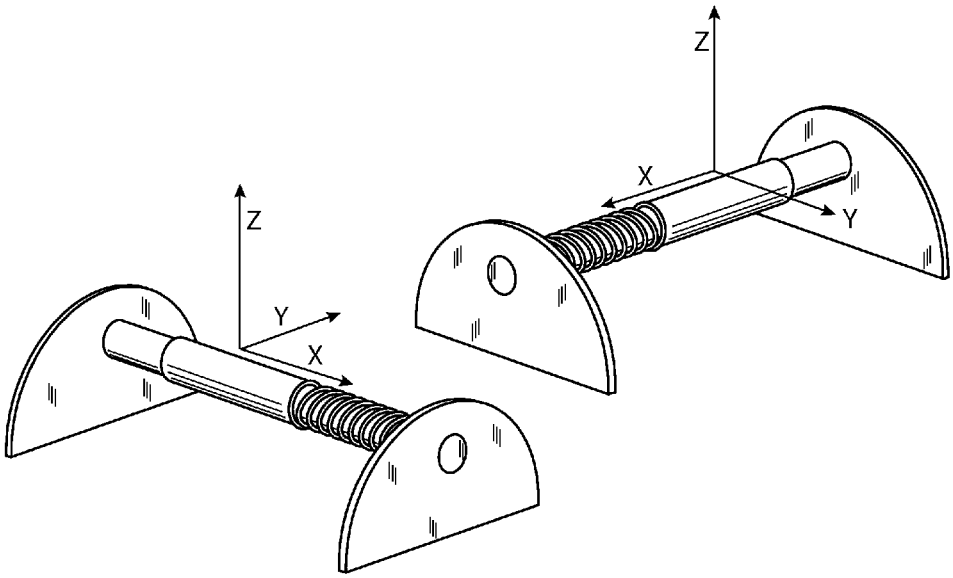
FIG. 8 is a perspective view of two push-up exercise devices capable of being individually oriented 360 degrees in relation to the plane of the surface for which each of the devices rest in accordance with the features of the present invention.

A unique feature of FIGS. 1-7 relates to the user's ability to individually orientate, or otherwise turn, the push-up bars 100, 100', 700, 700' about a 360 degree axis, shown in FIG. 8, in relation to the plane of the floor surface for which the push-up device rests so that the user may adjust the direction of the axially linear resistance provided against the user during push-ups, plank exercises, mountain climbers, and the like. Thus, the user is able to configure the orientation of each of the pair of push-up bars and the distance in relation to the other push-up bar and the person using the pair of push-up bars. For example, FIG. 9 depicts an orientation in which the user has positioned the handles so that the resistance is placed in the direction of the users feet when the user is in a pushup or plank position. However, in accordance with the combination of FIGS. 8 and 9, it is appreciated and part of the invention that the user could bring the two device close together, further apart, up or down, staggered or even, in relation to each other or in relation to the user. Further, the user could rotate the device in relation to each other by rotating the users hands. Changing the position of each device in relation to the other device and further in relation to the user affects the muscles exercised and the resistance applied. The position of push-up device in relation to the user shown in FIG. 9 provides significant abdominal isotonic and/or isometric exercise when the user slides the grip members downwards toward the user's feet.

What is claimed is:

1. An exercise apparatus, comprising:

a first push-up device, having:

a first base member adapted to rest on a supporting floor surface; and a first grip member secured to the first base member, adapted to be gripped by a first hand of a user, and further adapted to slidingly axially engage a first resistance member when a force is applied to the grip member by the user; and a second push-up device, having:

a second base member adapted to rest on the supporting floor surface; and a second grip member secured to the second base member, adapted to be gripped by a second hand of the user and further adapted to slidingly axially engage a second resistance member when a force is applied to the grip member by the user.

2. The exercise apparatus of claim 1, wherein each of the first and second resistance members are adapted to slidingly compress in relation to at least one axis.

3. The exercise apparatus of claim 1, wherein the first grip member is adapted to slidingly engage the first resistance member when moving along a first axis, and wherein the second grip member is adapted to slidingly engage the second resistance member when moving along a second axis, wherein the first axis and second axis are non-collinear.

4. The exercise apparatus of claim 1, wherein the first push-up device is freely positioned in relation to the second push-up device.

5. The exercise apparatus of claim 1, wherein each of the first push-up device and the second push-up device is individually orientated about the supporting floor surface.

6. The exercise apparatus of claim 1, wherein the first grip member is axially aligned with the first resistance member and the second grip member is axially aligned with the second resistance member.

7. The exercise apparatus of claim 1, wherein the first grip member is positioned perpendicular to the first resistance member and the second grip member is positioned perpendicular to the second resistance member.

8. The exercise apparatus of claim 1, wherein the first base member and the second base member each include an unstable lower surface adapted to provide user instability under load.

9. The exercise apparatus of claim 8, wherein the unstable lower surface defines a bowed supporting surface.

10. The exercise apparatus of claim 8, wherein the unstable lower surface includes non-slip properties.

11. The exercise apparatus of claim 8, wherein the unstable lower surface defines a flexible bladder at least partially filled with air.

12. The exercise apparatus of claim 1, wherein the first base member removably couples to the second base member to form a single push-up device.

13. The exercise apparatus of claim 1, wherein at least one of the first resistance member and the second resistance member is selectively replaceable.

14. The exercise apparatus of claim 1, further comprising an adjuster disposed on the push-up apparatus that is operable to selectively adjust the resistance on at least one of the first grip member and the second grip member.

15. An exercise apparatus, comprising:

a first push-up device, comprising:

a first base member adapted to rest on a supporting floor surface; and a first sole grip member secured to the first base member adapted to be gripped by a first hand of a user and further adapted to slidingly axially engage a first resistance member from a force provided by the user; and a second push-up device, comprising:

a second base member adapted to rest on a supporting floor surface; and a second sole grip member secured to the second base member adapted to be gripped by a second hand of the user and further adapted to slidingly axially engage a second resistance member from a force provided by the user.

16. A method for muscular exercise, comprising:

providing a first push-up device, having:

a first base member adapted to rest on a supporting floor surface; and a first grip member secured to the first base member, adapted to be gripped by a first hand of a user, and further adapted to slidingly axially engage a first resistance member when a force is applied to the grip member by the user;

providing a second push-up device, having:

a second base member adapted to rest on the supporting floor surface; and a second grip member secured to the second base member, adapted to be gripped by a second hand of the user and further adapted to slidingly axially engage a second resistance member when a force is applied to the grip member by the user; and simultaneously placing a downward force and opposing lateral forces with respect to the floor surface on the first grip member and the second grip member and moving the first grip member closer to the second grip member.

17. The method for muscular exercise of claim 16, the method further comprising:

compressing axially the first and second resistance members during muscular exercise.

18. The method for muscular exercise of claim 16, the method further comprising:

disengaging a removable portion of at least one of the first and second base members from at least one of the first and second grip members.

19. The method for muscular exercise of claim 18, the method further comprising:

replacing the first and second resistance members, each having a first resistance level, with at least one new resistance member having a second resistance level different than the first resistance level.

20. The method for muscular exercise of claim 16, the method further comprising:

rolling at least one of the first and second push-up device along a perimeter edge of at least one of the first and second base member.

* * * * *